US012799690B2

(12) United States Patent
Moore et al.

(10) Patent No.: US 12,799,690 B2
(45) Date of Patent: Nov. 17, 2026

(54) SELF-CLEANING EXPANSION JOINT SYSTEM

(71) Applicant: SIKA TECHNOLOGY AG, Baar (CH)

(72) Inventors: Gary Moore, Amherst, NY (US); Gregory Ross, Amherst, NY (US); Paul Pumm, Amherst, NY (US); Adam Smith, Amherst, NY (US)

(73) Assignee: SIKA TECHNOLOGY AG, Baar (CH)

( * ) Notice: Subject to any disclaimer, the term of this patent is extended or adjusted under 35 U.S.C. 154(b) by 984 days.

(21) Appl. No.: 18/049,463

(22) Filed: Oct. 25, 2022

(65) Prior Publication Data

US 2024/0133135 A1 Apr. 25, 2024
US 2024/0229381 A9 Jul. 11, 2024

(51) Int. Cl.
*E01D 19/06* (2006.01)

(52) U.S. Cl.
CPC ..... *E01D 19/065* (2013.01)

(58) Field of Classification Search
CPC ..... E01D 19/065; E01D 19/06; E01D 19/062
See application file for complete search history.

(56) References Cited

U.S. PATENT DOCUMENTS 3,677,145 A * 7/1972 Wattiez ..... E01D 19/06 404/58
4,885,885 A * 12/1989 Gottschling ..... E01D 19/065 404/47
4,914,884 A * 4/1990 Ohmatsu ..... E04B 1/6815 404/47
5,048,249 A * 9/1991 Shreiner ..... E04B 1/6804 404/69
6,460,214 B1 * 10/2002 Chang ..... E01D 19/06 14/73.1
6,609,265 B1 * 8/2003 Jee ..... E01D 19/06 14/73.1
11,987,942 B2 * 5/2024 Park ..... E01D 19/065
(Continued)

FOREIGN PATENT DOCUMENTS

KR 20090092209 A * 8/2009 ..... E01D 19/062
WO WO-2015120993 A2 * 8/2015 ..... E04B 1/681

*Primary Examiner* — Abigail A Risic
(74) *Attorney, Agent, or Firm* — Oliff PLC

(57) ABSTRACT

An expansion joint system for bridging a gap between spaced apart structural members and capable of self-cleaning. The expansion joint system includes first and second base members, at least one upwardly sloped base plate engaged with one of the first and second base members, and at least one substantially horizontal movable plate engaged with at least one of the first and second base members. Also disclosed is an expansion joint including a first structural member and a second structural member, first and second base members, at least one upwardly sloped base plate engaged with one of the first and second base members, and at least one substantially horizontal movable plate engaged with at least one of the first and second base members. Also disclosed is an expansion joint for a bridge or roadway including first and second structural members, first and second base members, at least one upwardly sloped base plate engaged with at least one of the first and second base members, and at least one substantially horizontal movable plate.

19 Claims, 3 Drawing Sheets

(56) References Cited

U.S. PATENT DOCUMENTS

| | | | | |
|---|---|---|---|---|
| 2002/0032997 | A1* | 3/2002 | Shreiner | E01D 19/06 52/461 |
| 2002/0138925 | A1* | 10/2002 | Chang | E01D 19/06 14/73.1 |
| 2022/0341106 | A1* | 10/2022 | Park | E01D 19/06 |

* cited by examiner

SELF-CLEANING EXPANSION JOINT SYSTEM

TECHNICAL FIELD

The present disclosure is directed to a self-cleaning expansion joint system for bridging a gap between spaced apart structural members. Additionally disclosed is an expansion joint having the self-cleaning expansion joint system mounted to underlying spaced-apart structural members. Constructions, such as roadway, highway, and bridges structures, incorporating the self-cleaning expansion joint system are further provided.

BACKGROUND

Dimensional changes occur between structural members in response to expansion and contraction due to, for example, temperature changes, shortening and creep caused by pre-stressing concrete members, seismic cycling, vibrations, deflections caused by live loads, longitudinal forces caused by wind loads, and vehicular traffic. A gap is purposefully provided between the adjacent structural members for accommodating these dimensional changes. These dimensional changes result in the expansion and contraction of the width of the gap between the spaced apart structural members. Expansion joint systems are positioned within the gap to accommodate the movements in the vicinity of the gap, but still permit flow of traffic across the gap.

Types of expansion joint systems include, but are not limited to, modular expansion joint systems and finger expansion joint systems. Current expansion joint systems require routine maintenance and cleaning due to, for example, the collection of runoff and debris because the debris can become embedded in the gap. This prevents movement and may cause damage to the overall expansion joint system. This maintenance and cleaning can be quite costly and lead to extensive roadway closures. Accordingly, there is a long felt need in the expansion joint industry for an improved expansion joint system that is capable of self-cleaning.

SUMMARY

Provided is an expansion joint system having a first base member and a second base member. At least one base plate is engaged with at least one of the first and second base members and is upwardly sloped therefrom. A substantially horizontal movable plate is also engaged with at least one of the first and second base members.

Additionally provided is an expansion joint having a first structural member and a second structural member spaced-apart in the longitudinal direction from the first structural member. There is a first base member and a second base member. At least one base plate is engaged with at least one of the first and second base members and is upwardly sloped therefrom. A substantially horizontal movable plate is also engaged with at least one of the first and second base members.

Additionally provided is an expansion joint for a bridge or roadway having a first structural member and a second structural member spaced-apart in the longitudinal direction from the first structural member. A first base member is engaged with the first structural member and a second base member is engaged with the second structural member. At least one base plate is engaged with at least one of the first and second base members and is upwardly sloped therefrom. A substantially horizontal movable plate is also engaged with at least one of the first and second base members.

BRIEF DESCRIPTION OF THE DRAWINGS

Certain illustrative embodiments of the expansion joint system, expansion joint, and bridge and roadway constructions are disclosed with reference to the accompanying drawings and are for illustrative purposes only. The disclosed subject matter is not limited in its application to the details of construction or arrangement of the components illustrated in the drawings. Like reference numerals are used to indicate like components, unless otherwise indicated. The present disclosure will be more readily understood from the detailed description of illustrative embodiments presented below considered in conjunction with the drawings, of which.

DETAILED DESCRIPTION

Figure 1:
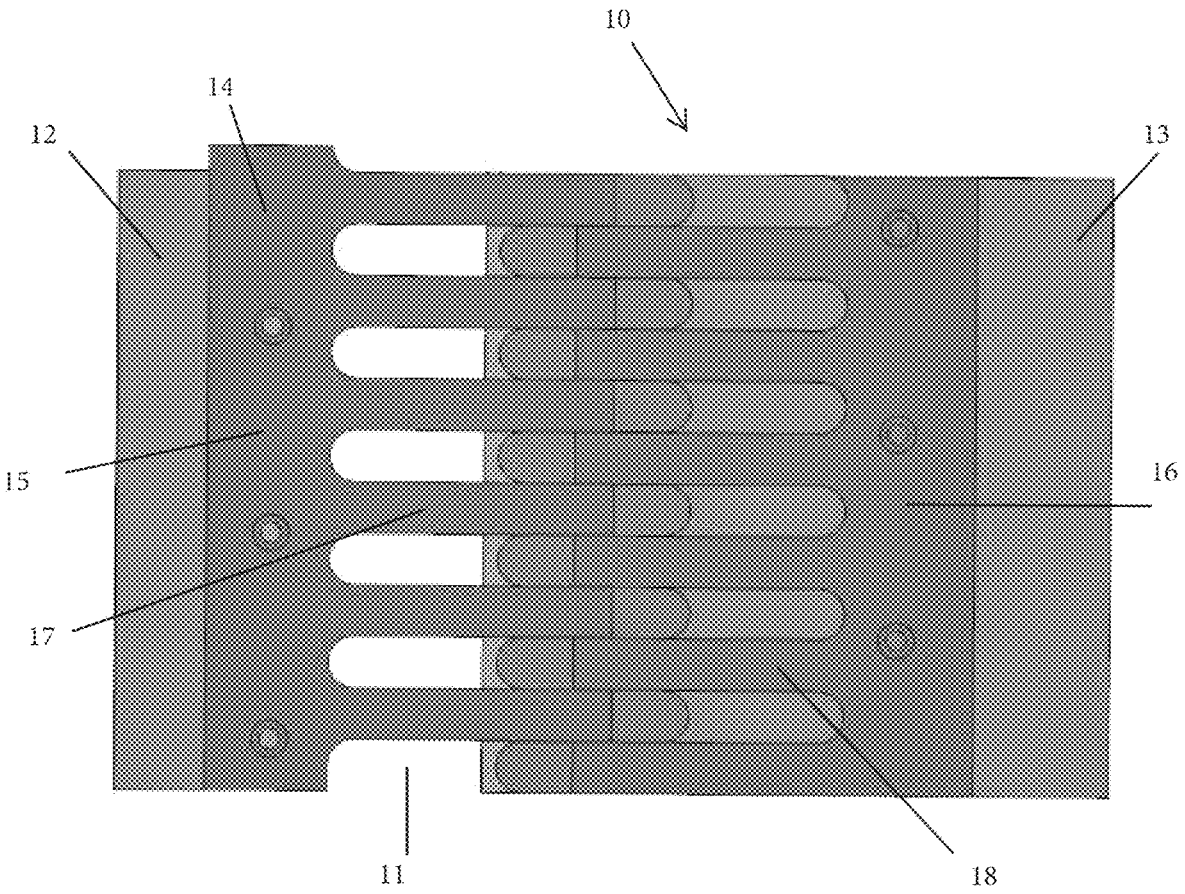
FIG. 1 is a plan view of an illustrative embodiment of the expansion joint system according to the present disclosure.

The following text sets forth a broad description of numerous different embodiments of the present disclosure. The description is to be construed as exemplary only and does not describe every possible embodiment since describing every possible embodiment would be impractical, if not impossible. It will be understood that any feature, characteristic, component, composition, ingredient, product, step, or methodology described herein can be deleted, combined with or substituted for, in whole or part, any other feature, characteristic, component, product, step or methodology described herein. Numerous alternative embodiments could be implemented, using either current technology or technology developed after the filing date of this patent, which would still fall within the scope of the claims.

As used herein, the terms "about," and "substantially," and any other version thereof, or any other similar relative term, or similar term of approximation, are defined as being close to as understood by one having ordinary skill in the art.

As used herein, the term "engage," and any other version thereof, or any other similar relative term, can mean that the components are fixedly connected (e.g., by non-limiting example, by welding), removably connected (e.g., by non-limiting example, by mechanical fasteners, anchors, removable connection points, etc.), or merely touching (e.g., by non-limiting example, one component resting upon another).

Disclosed is an expansion joint system having a first base member and a second base member. At least one base plate is engaged with at least one of the first and second base members and is upwardly sloped therefrom. At least one substantially horizontal movable plate is engaged with at least one of the first and second base members.

In an illustrative embodiment, the expansion joint system has a first base member and a second base member. A first base plate is engaged with the first base member and is upwardly sloped therefrom. A second base plate is engaged with the second base member and is upwardly sloped therefrom. At least one substantially horizontal movable plate is engaged with at least one of the first and second base members.

In an illustrative embodiment, a first movable plate is engaged with the first base member and a second moveable plate is engaged with the second base member. In an illustrative embodiment, a first movable plate is engaged with the first base plate and a second movable plate is engaged with a second base plate.

In an illustrative embodiment, the expansion joint system also has at least one stiffening member engaged with at least one base plate. In some embodiments, a first stiffening plate is engaged with a first base plate and a second stiffening plate is engaged with a second base plate. In an illustrative embodiment, the expansion joint system also has at least one stiffening member engaged with at least one base member. In some embodiments, a first stiffening plate is engaged with a first base member and a second stiffening plate is engaged with a second base member.

In an illustrative embodiment, the stiffening member can have a plurality of openings.

In an illustrative embodiment, the expansion joint system can have, by way of non-limiting example, a modular or finger configuration. In some illustrative embodiments, the expansion joint system has a finger configuration. When the expansion joint system has a finger configuration, the at least one movable plate can comprise a first movable plate comprising a plurality of fingers pivotally engaged with a first base member and/or first base plate and a second movable plate comprising a plurality of fingers pivotally engaged with a second base member and/or a second base plate. In some illustrative embodiments, the plurality of fingers on the first and second movable plates are interdigitated. In some illustrative embodiments, the plurality of fingers on the first and second movable plates are configured to extend longitudinally and in a substantially horizontal manner across an expansion joint gap located between two spaced-apart structural members.

In an illustrative embodiment, the expansion joint system can have a trough. The trough is configured to have a first end and a second end. The first end engages with the first base member and the second end engages with the second base member. In an illustrative embodiment, the trough is comprised of a flexible material. In certain other embodiments, the trough is comprised of a rigid material.

In an illustrative embodiment, the first and second base members are elongated C-shaped channels and/or "L-shaped" brackets. In further illustrative embodiments, the first and second base members are a pair of opposite facing elongated C-shaped channels and/or "L-shaped" brackets. In some illustrative embodiments the first and second base members further include a connector point capable of engaging with the first and second ends of a trough, respectively.

As used in the present disclosure, the term "longitudinal direction" means the direction of traffic across the expansion joint system. The term "transverse direction" means a direction which has at least a component extending perpendicular to the direction of traffic across the expansion joint system, or substantially perpendicular to the longitudinal direction.

Additionally disclosed is an expansion joint having a first structural member and a second structural member spaced-apart in the longitudinal direction from the first structural member. An expansion joint gap exists between the vertical marginal edges of the first and second structural members respectively. The expansion joint further has a first base member and a second base member. At least one base plate is engaged with at least one of the first and second base members and is upwardly sloped therefrom (e.g., away from the gap). At least one substantially horizontal movable plate is engaged with at least one of the first and second base members. The at least one substantially horizontal movable plate extends substantially horizontally across the expansion joint gap.

The first and second base members may be engaged with the underlying first and second structural members by at least partially embedding the first and second base members in the respective structural members, and/or by mechanical fasteners engaged both the base members and penetrating into the structural members. In certain embodiments, the mechanical fasteners can comprise elongated bolts having a head and a threaded portion depending downwardly from the head of the bolt. The first and second base members may comprise, for example, elongated C-shaped channels, a pair of opposite facing elongated C-shaped channels, substantially "L-shaped" brackets, and/or a pair of opposite facing elongated substantially "L-shaped" brackets.

In illustrative embodiments, the at least one movable plate may be engaged with only the first base member, only the second base member, or both the first and second base member. The at least one movable plate may be engaged with only a first base plate, only a second base plate, or both a first and second base plate. The at least one movable plate may comprise a first movable plate engaged with the first base member and/or first base plate and a second movable plate engaged with the second base member and/or second base plate.

In illustrative embodiments, the expansion joint may have at least one stiffening member. The stiffening member may be engaged with at least one base plate. In some embodiments, a first stiffening plate is engaged with a first base plate and a second stiffening plate is engaged with a second base plate. In an illustrative embodiment, the expansion joint system also has at least one stiffening member engaged with at least one base member. In some embodiments, a first stiffening plate is engaged with a first base member and a second stiffening plate is engaged with a second base member. In certain embodiments, the stiffening member may have a plurality of openings. The plurality of openings, for example, permit dirt and debris to fall into the gap.

In an illustrative embodiment, the expansion joint can have, by way of nonlimiting example, a modular or finger configuration. In some illustrative embodiments, the expansion joint system has a finger configuration. When the expansion joint system has a finger configuration, the at least one movable plate can comprise a first movable plate comprising a plurality of fingers pivotally engaged with a first base member and/or first base plate and a second movable plate comprising a plurality of fingers pivotally engaged with a second base member and/or a second base plate. In some illustrative embodiments, the plurality of fingers on the first and second movable plates are interdigitated. In some illustrative embodiments, the plurality of fingers on the first and second movable plates are configured to extend longitudinally and in a substantially horizontal manner across an expansion joint gap located between two spaced-apart structural members.

In an illustrative embodiment, the expansion joint can have a trough. The trough is configured to have a first end and a second end. The first end engages with the first base member and the second end engages with the second base member. In an illustrative embodiment, the trough is comprised of a flexible material. In certain other embodiments, the trough is comprised of a rigid material.

In an illustrative embodiment, the first and second base members are elongated C-shaped channels and/or "L-shaped" brackets. In further illustrative embodiments, the first and second base members are a pair of opposite facing elongated C-shaped channels. In other embodiments, the first and second base members have an "L-shaped" configuration. In some illustrative embodiments the first and second base members further include a connector portion capable of engaging with the first and second ends of a trough, respectively.

The underlying structural members may comprise, for example, concrete or steel bridge, roadway, and the like structural members.

Additionally disclosed is an expansion joint for a bridge or roadway having a first structural member and second structural member spaced-apart in the longitudinal direction from the first structural member. A first base member is engaged with the first structural member and a second base member is engaged with the second structural member. At least one base plate is engaged with at least one of the first and second base members and is upwardly sloped therefrom (e.g., away from the gap formed between the first and second structural members). At least one substantially horizontal movable plate is engaged with at least one of the first and second base members and may have a dimension sufficient to span a gap between the first and second structural members.

FIG. 1 shows a plan view of an illustrative embodiment of the expansion joint system (10) according to the present disclosure. The expansion joint system bridges a gap (11) between a first structural member (12) and a second structural member (13). The expansion joint system (10) includes a finger configuration and has at least one movable plate (14). The at least one movable plate is substantially horizontal and comprises a plurality of first and second plates (15, 16) each comprising a plurality of fingers (17, 18) pivotally engaged with the first base member (19) and the second base member (20) respectively (not shown). The plurality of fingers (17) on the plurality of first plates (15) are interdigitated with the plurality of fingers (18) on the plurality of second plates (16). The plurality of fingers (17, 18) extend across, and effectively bridge, the gap (11) from opposing sides of the gap (11). The plurality of plates are engaged, or otherwise mounted or secured, to the underlying first and second structural members (12, 13), such as underlying bridge or roadway structural members, respectively.

Figure 2:
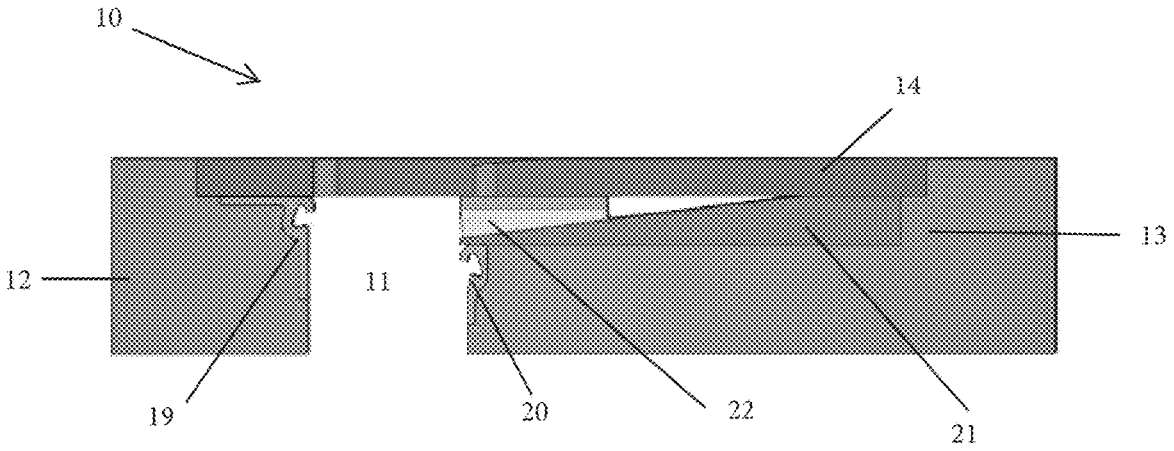
FIG. 2 is a cross-section view of an illustrative embodiment of the expansion joint system according to the present disclosure.

FIG. 2 shows a cross-section view of an illustrative embodiment of the expansion joint system (10) according to the present disclosure. In this embodiment, the expansion joint system (10) bridges a gap (11) between a first structural member (12) and a second structural member (13). The expansion joint system (10) includes at least one substantially horizontal movable plate (14) to effectively bridge the gap (11) between the first and second structural members (12, 13). The first base member (19) is substantially "L-shaped" and is engaged, or otherwise mounted or secured, to the first structural member (12). The second base member (20) is also substantially engaged, or otherwise mounted or secured, to the second structural member (13). A base plate (21) is engaged with the second base member (20) and is upwardly sloped in the direction away from the gap (11). The base plate (21) may be welded to the second base member (20). A stiffening member (22) is engaged with the base plate (21). The stiffening member (22) may provide support for the at least one movable plate (14).

Figure 3:
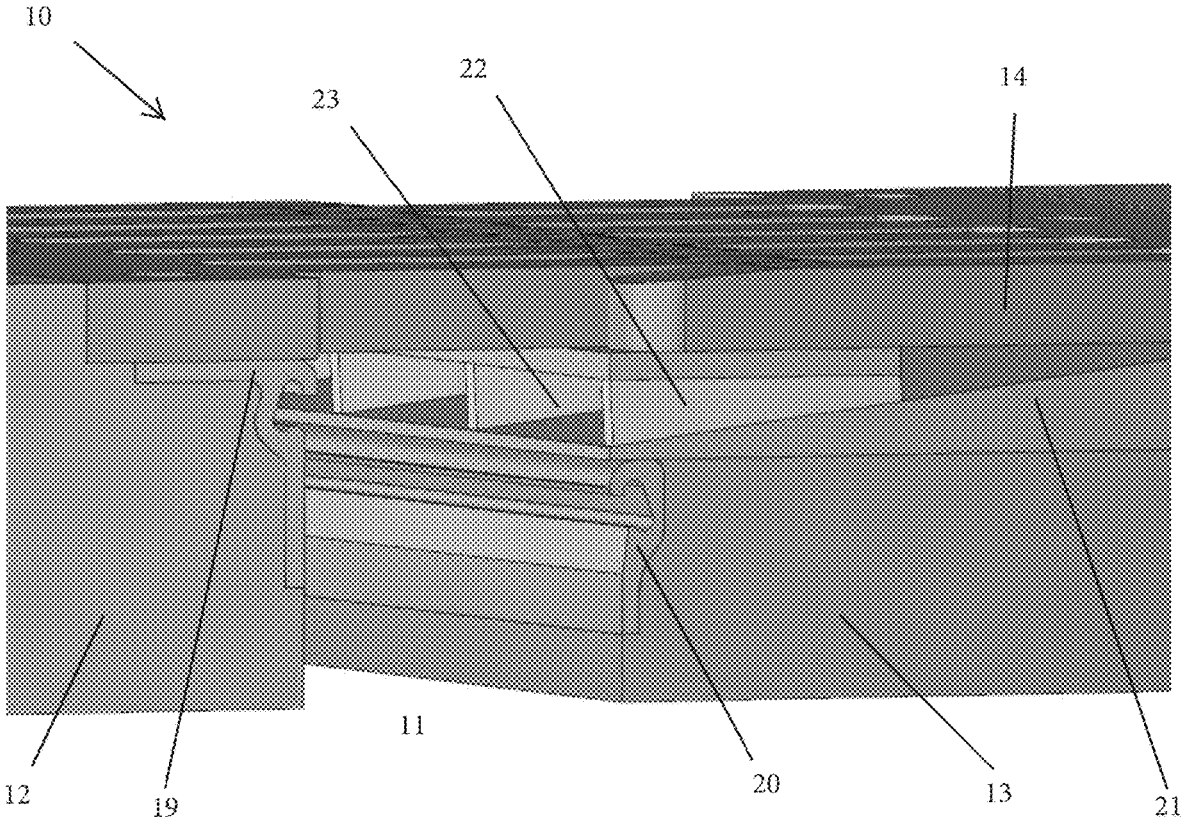
FIG. 3 is a perspective view showing an illustrative embodiment of the stiffening member of the expansion joint system of FIG. 2.

FIG. 3 shows an illustrative embodiment of the stiffening member (22) of the expansion joint system (10) of FIG. 2. The bottom end of the stiffening member (22) is upwardly sloped in the direction away from the gap (11) to substantially conform to the upward slope of the base plate (21). The top end of the stiffening member (22) is substantially horizontal and may provide support for the at least one movable plate (14). The stiffening member (22) may be elongated to be substantially similar to the length of the structural members (12, 13) and the gap (11) formed therebetween. The stiffening member (22) comprises at least one opening (23). The opening (23) permits debris to be moved into the gap.

Figure 4:
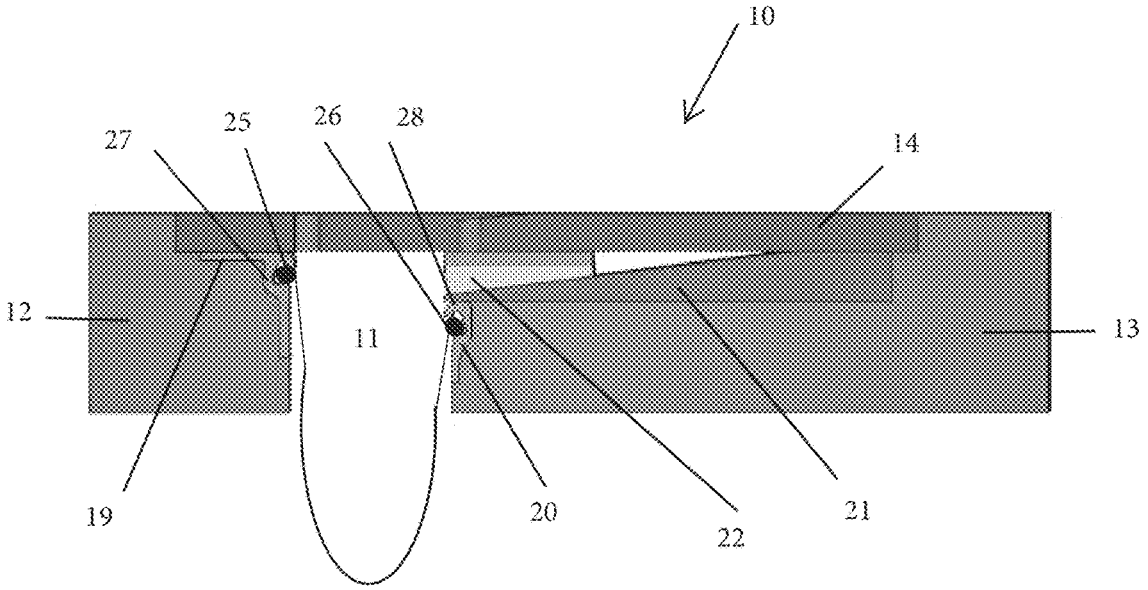
FIG. 4 is cross-section view of the illustrative embodiment of the expansion joint system according to FIG. 2 further comprising a trough.

FIG. 4 shows a cross-section view of the illustrative embodiment of the expansion joint system (10) according to FIG. 2 further comprising a trough (24). In this embodiment, the expansion joint system (10) bridges a gap (11) between a first structural member (12) and a second structural member (13), including at least one substantially horizontal movable plate (14). This embodiment shows the first base member (19) and the second base member (20) further including connection points (27, 28). A base plate (21) is engaged with the second base member (20) and is upwardly sloped in the direction away from the gap (11). A stiffening member is engaged with the base plate (21). The trough (24) has a first end (25) and second end (26). The first end (25) of the trough (24) may be designed to engage with the connection point (27) on the first base member (19), and the second end (26) of the trough (24) may be designed to engage with the connection point (28) on the second base member (20). The trough (24) is designed to catch debris in scenarios where the debris cannot be permitted to ultimately fall beneath the expansion joint system, for example, into waterways, underlying roadways, etc.

Figure 5:
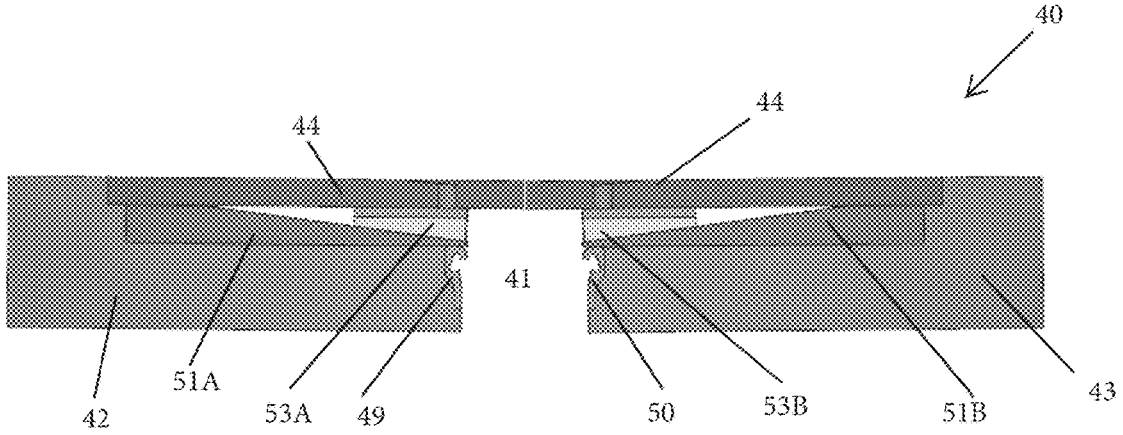
FIG. 5 is a cross-section view of an illustrative embodiment of the expansion joint system according to the present disclosure.

FIG. 5 shows an elevation view of an illustrative embodiment of an expansion joint system (40) according to the present disclosure. In this embodiment, the expansion joint system (40) bridges a gap (41) between a first structural member (42) and a second structural member (43). The expansion joint system (40) includes at least one substantially horizontal movable plate (44) to effectively bridge the gap (41) between the first and second structural members (42, 43). This embodiment further includes first and second base members (49, 50). The first base member (49) is substantially engaged, or otherwise mounted or secured, to the first structural member (42). The second base member (50) is also substantially engaged, or otherwise mounted or secured, to the second structural member (43). A first base plate (51A) is engaged with the first base member (49) and is upwardly sloped in the direction away from the gap (41). A second base plate (51B) is engaged with the second base member (50) and is upwardly sloped in the direction away from the gap (41). The first and second base plates (51A, 51B) may be welded to the first and second base members (49, 50) respectively. A first stiffening member (53A) is engaged with the first base plate (51A) and a second stiffening member (53B) is engaged with the second base plate (51B).

It is understood that the exemplary embodiments are merely illustrative of the disclosure and that many variations of the above-described embodiments can be derived by one skilled in the art without departing from the scope of the disclosure. It is therefore intended that all such variations be included within the scope of the following claims and their equivalents.

The invention claimed is:

1. An expansion joint system comprising:

a first base member and a second base member;

at least one base plate engaged with at least one of the first and second base members, wherein the at least one base plate is upwardly sloped from at least one of the first and second base member;

at least one movable plate engaged with at least one of the first and second base members, wherein the at least one movable plate is substantially horizontal; and at least one stiffening member engaged with at least one base plate, wherein the at least one stiffening member has a plurality of openings and the plurality of openings are configured to move a debris into a gap having a triangular wedge shape.

2. The expansion joint system according to claim 1, wherein the expansion joint system comprises a modular or finger configuration.

3. The expansion joint system according to claim 1, wherein the at least one movable plate comprises: a first plate comprising a plurality of fingers configured to engage with the first base member; and a second plate comprising a plurality of fingers configured to engage with the second base member, wherein the plurality of fingers of the first and second plates are interdigitated.

4. The expansion joint system according to claim 1, further comprising a trough comprising a first end and a second end, wherein the first end engages with the first base member and the second end engages with the second base member.

5. The expansion joint system according to claim 4, wherein the first and second ends are removably engaged.

6. The expansion joint system of claim 4, wherein the trough is comprised of a flexible material.

7. The expansion joint system according to claim 1, wherein at least one of the first and second base members comprise at least one of elongated C-shaped channels and L-shaped brackets.

8. The expansion joint system according to claim 7, wherein the first and second base members comprise at least one of a pair of opposite facing elongated C-shaped channels and a pair of opposite facing elongated L-shaped brackets.

9. An expansion joint comprising:

a first structural member and a second structural member spaced-apart in a longitudinal direction from the first structural member;

a first base member and a second base member;

at least one base plate engaged with at least one of the first and second base members, wherein the at least one base plate is upwardly sloped from at least one of the first and second base member;

at least one movable plate engaged with at least one of the first and second base members, wherein the at least one movable plate is substantially horizontal; and at least one stiffening member engaged with at least one base plate, wherein the at least one stiffening member has a plurality of openings and the plurality of openings are configured to move a debris into a gap having a triangular wedge shape.

10. The expansion joint according to claim 9, wherein the expansion joint comprises a modular or finger configuration.

11. The expansion joint according to claim 10, wherein the expansion joint comprises a finger configuration and wherein the at least one movable plate comprises:

a first plate comprising a plurality of fingers pivotally engaged with a first support; and a second plate comprising a plurality of fingers pivotally engaged with a second support;

wherein the plurality of fingers of the first and second plates extend across a gap between the first and second structural members.

12. The expansion joint according to claim 11, wherein the plurality of fingers of the first and second plates are interdigitated.

13. The expansion joint according to claim 9, wherein the first base member is engaged with the first structural member and the second base member is engaged with the second structural member.

14. The expansion joint according to claim 9, further comprising a trough comprising a first end and a second end, wherein the first end engages with the first base member and the second end engages with the second base member.

15. The expansion joint according to claim 14, wherein the first and second ends are removably engaged.

16. The expansion joint according to claim 14, wherein the trough is comprised of a flexible material.

17. The expansion joint according to claim 9, wherein at least one of the first and second base members comprise at least one of elongated C-shaped channels and elongated L-shaped brackets.

18. The expansion joint according to claim 17, wherein the first and second base members comprise at least one of a pair of opposite facing elongated C-shaped channels and a pair of opposite facing elongated L-shaped brackets.

19. An expansion joint for a bridge or roadway comprising:

a first structural member;

a second structural member spaced-apart in a longitudinal direction from the first structural member;

a first base member engaged with the first structural member;

a second base member engaged with the second structural member;

at least one base plate engaged with at least one of the first and second base members, wherein the at least one base plate is upwardly sloped from at least one of the first and second base member;

at least one movable plate engaged with at least one of the first and second base members, wherein the at least one movable plate is substantially horizontal; and at least one stiffening member engaged with at least one base plate, wherein the at least one stiffening member has a plurality of openings and the plurality of openings are configured to move a debris into a gap having a triangular wedge shape.

* * * * *